US008667620B2

(12) United States Patent
Mueller et al.

(10) Patent No.: US 8,667,620 B2
(45) **Date of Patent: *Mar. 11, 2014**

(54) TOILET WITH REDUCED WATER USAGE

(75) Inventors: Jeffrey L. Mueller, Plymouth, WI (US); Terrence J. Andersen, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/441,529

(22) Filed: Apr. 6, 2012

(65) Prior Publication Data

US 2012/0192342 A1 Aug. 2, 2012

Related U.S. Application Data

(63) Continuation of application No. 11/800,723, filed on May 7, 2007, now Pat. No. 8,151,379.

(51) Int. Cl.
*E03D 11/00* (2006.01)

(52) U.S. Cl.
USPC ..... 4/420

(58) Field of Classification Search
USPC ..... 4/420–421, 424–425
See application file for complete search history.

(56) References Cited

U.S. PATENT DOCUMENTS

| | | | | |
|---|---|---|---|---|
| 4,930,167 | A | 6/1990 | Ament | |
| 5,218,726 | A | 6/1993 | Jaeckels et al. | |
| 5,283,913 | A | 2/1994 | Jaeckels | |
| 6,145,138 | A | 11/2000 | Nakamura et al. | |
| 6,397,405 | B1 | 6/2002 | Grech et al. | |
| 6,584,623 | B2 | 7/2003 | Grech et al. | |
| 7,111,333 | B1 | 9/2006 | Lo et al. | |
| 8,151,379 | B2 * | 4/2012 | Mueller et al. | 4/420 |
| 2003/0115664 | A1 | 6/2003 | Kosugi et al. | |
| 2004/0040080 | A1 | 3/2004 | Prokopenko et al. | |
| 2005/0166308 | A1 | 8/2005 | Miwa et al. | |

OTHER PUBLICATIONS

Toto advertisement entitled "Cyclone Flushing System by Toto"; undated; admitted prior art; 2 pages.

* cited by examiner

*Primary Examiner* — Lori Baker
(74) *Attorney, Agent, or Firm* — Foley & Lardner LLP

(57) ABSTRACT

A toilet, comprising a bowl, a rim provided at an upper portion of the bowl, a rim channel disposed in the rim, a rear extension that extends from the rim, and a water distribution structure provided in the rear extension and configured to receive water from a water supply. The rim channel includes a first opening, a second opening, and a third opening located between the first and second openings, the openings being configured to communicate water to the bowl. The water distribution structure having at least two exit channels configured to communicate water to at least two different locations of the rim channel.

20 Claims, 8 Drawing Sheets

TOILET WITH REDUCED WATER USAGE

CROSS-REFERENCE TO RELATED APPLICATIONS

The present application is a Continuation of U.S. patent application Ser. No. 11/800,723 filed May 7, 2007, which has issued as U.S. Pat. No. 8,151,379. U.S. patent application Ser. No. 11/800,723 is incorporated by reference herein in its entirety.

BACKGROUND

This invention relates generally to toilets that can remove waste from a toilet bowl efficiently with small amounts of water.

Water shortages are serious problems in many regions. This had led to government regulation regarding water use efficiency of certain products. For example, some jurisdictions regulate the maximum amount of water used by a toilet during a flush. While usage of as much as 7 gallons per flush was conventional in the early 1950s, current regulations in some jurisdictions require that no more than 1.6 gallons of water be used per flush. There are proposals to reduce the permitted usage further (e.g., to 1.2 gallons/flush).

Even when there is no governmental requirement restricting water usage, environmentally conscious consumers often prefer low water usage toilets. Moreover, water utilities are significantly increasing the cost of water supply, providing yet another motivation for consumers to prefer low water usage toilets.

As water usage per flush cycle is reduced, it is important that cleaning efficiency remain at acceptable levels. If cleaning efficiency is compromised, the consumer will in some situations be led to flush a second time, frustrating the regulatory, conservation, and cost savings goals.

Complicating matters is that in addition to cleaning the bowl sides, the flush water has other functions. It is typically used to form a gravity siphon which helps move the waste out of the bowl. Also, the water is needed to rinse the bowl once the main waste has been dislodged and evacuated. Further, water is needed to re-establish an odor seal in the trap. Also, water needs to be available to clean the entire circumference of the bowl. These additional requirements complicate the design of low water usage toilets.

One way to improve the efficiency of cleaning is to pressurize the cleaning supply of water. However, this can unacceptably increase the cost of the toilet.

Another approach is to split the rim flow into two unequal branches. See, for example, U.S. Pat. Nos. 4,930,167 and 6,397,405. However, prior systems of this type could have evacuation issues at low water usage rates.

Another approach is to use a tapered passage at the bottom of the bowl near the bowl outlet (which generally is referred to as a "jet") to more efficiently start the siphon out of the bowl. See, for example, U.S. Pat. Nos. 5,218,726, 5,283,913 and 6,145,138. However, achieving adequate cleaning along the sides of the bowl is difficult with low water usage when a substantial portion of the water has been diverted for jet use.

Yet another approach is to use a multi-loop vortex flow approach. See, for example, U.S. Patent Application Publication No. 2004/0040080. This takes energy out of the water before it reaches the siphon trap, which could be problematic.

In U.S. Patent Application Publication No. 2003/0115664 there was a toilet disclosed with some rim flow along a right branch, some rim flow along a left branch, and some flow down and straight ahead. However, this design had certain inefficiencies which constrained the reduction in water usage. For example, water entered at a right angle to the rim, thereby dissipating cleaning energy. Further, some water was used in an opposing manner.

It is therefore desired to develop further improved toilets to reduce water usage without undesirably compromising cleaning or other water closet performance characteristics.

SUMMARY

An exemplary embodiment relates to a toilet which has a bowl having an upper rim channel and a water distribution structure for delivering water from a water supply to the bowl. The water distribution structure has an entry suitable to link with the water supply (e.g., a toilet tank or Flushometer type supply) and at least three exit channels.

A first of the exit channels communicates with the rim channel so as to provide at least counter clockwise flow around a first side of the rim channel. A second of the exit channels communicates with the rim channel so as to provide at least clockwise flow around an opposed side of the rim channel from the first side of the rim channel. A third of the exit channels communicates with a rearward portion of the rim channel.

The rim channel has a first enlarged opening to the bowl adjacent a rearward portion of the bowl, and a second enlarged opening to the bowl adjacent a forward portion of the bowl. The water distribution structure is configured so that when water is delivered to the rim channel a vortex of water will be developed in the bowl.

In an exemplary embodiment, the third exit channel is configured to feed water to the rim channel at an angle relative to the rim channel. Also, the first exit channel is suitable to carry a greater volume of water than the second exit channel (e.g., its cross sectional area is greater), and the first and second exit channels are each suitable to carry greater volumes of water than the third exit channel.

In another exemplary embodiment, the toilet bowl has a forward-to-back vertical central plane. The first and third exit channels link with the rim channel on one side of the vertical central plane and the second exit channel links with the rim channel on an opposite side of the vertical central plane.

In yet another exemplary embodiment, the first and second enlarged openings each have a central point on the same side of the vertical central plane, the bowl is provided with an integral rearward extension, the water distributor is integrally formed along the rearward extension, and the rim channel is an open rim style rim channel in which a gap between sides of the rim channel is varied to form the enlarged openings.

With this embodiment, entering water from the tank or other supply is thus split into three flows. One flow directly enters the bowl near its rear from the rim channel. Another flow, the primary flow, joins that first flow in part and in addition serves two other functions. One function is to wash one side of the bowl. Another is to pass almost to the front of the bowl and then enter the bowl in a large stream. Yet another flow is primarily to wash the opposite side of the bowl, albeit most preferably it also assists in washing the upper rear of the bowl.

The water enters the rim channels at an angle so as to keep the energy of the water largely intact. Surprisingly, the flow from the essentially forward (e.g., one o'clock or alternatively 11 o'clock) position avoids the need for a jet, thereby permitting all flow to enter from the rim channel in the exemplary embodiments.

Another exemplary embodiment relates to a toilet having a bowl with an upper rim channel, and a water distribution structure for delivering water from a water supply to the bowl. The water distribution structure has an entry suitable to link with the water supply and at least two exit channels.

A first of the exit channels communicates with the rim channel so as to provide both a counter clockwise flow and a clockwise flow around a first side of the rim channel if water is supplied to the toilet. There is also a second of the exit channels which communicates with the rim channel so as to provide a flow pattern selected from the group consisting of clockwise flow and counter clockwise flow around an opposed side of the rim channel from the first side of the rim channel if water is supplied to the toilet.

The rim channel has a first enlarged opening to the bowl adjacent a rearward portion of the bowl, and a second enlarged opening to the bowl adjacent a forward portion of the bowl. The water distribution structure is configured so that if water is delivered to the rim channel a vortex of water will be developed in the bowl.

Regardless of the aspect of the invention applied, as a result, with less water usage, effective cleaning can be achieved. The water is used in a way to also facilitate rinsing, evacuation and re-seal.

Current tests indicate that effective cleaning can be achieved at 1.6 gallons per flush, and further indicate that these toilets may provide effective cleaning with even lower levels of water use per flush. Such toilets can be manufactured using conventional molding techniques, without significant additional costs above those experienced with conventional cast toilets.

These and still other advantages of the present invention will become more apparent, and the invention will be better understood, by reference to the following description of preferred embodiments of the present invention which follows (with reference to the accompanying drawings).

DETAILED DESCRIPTION

Figure 1:
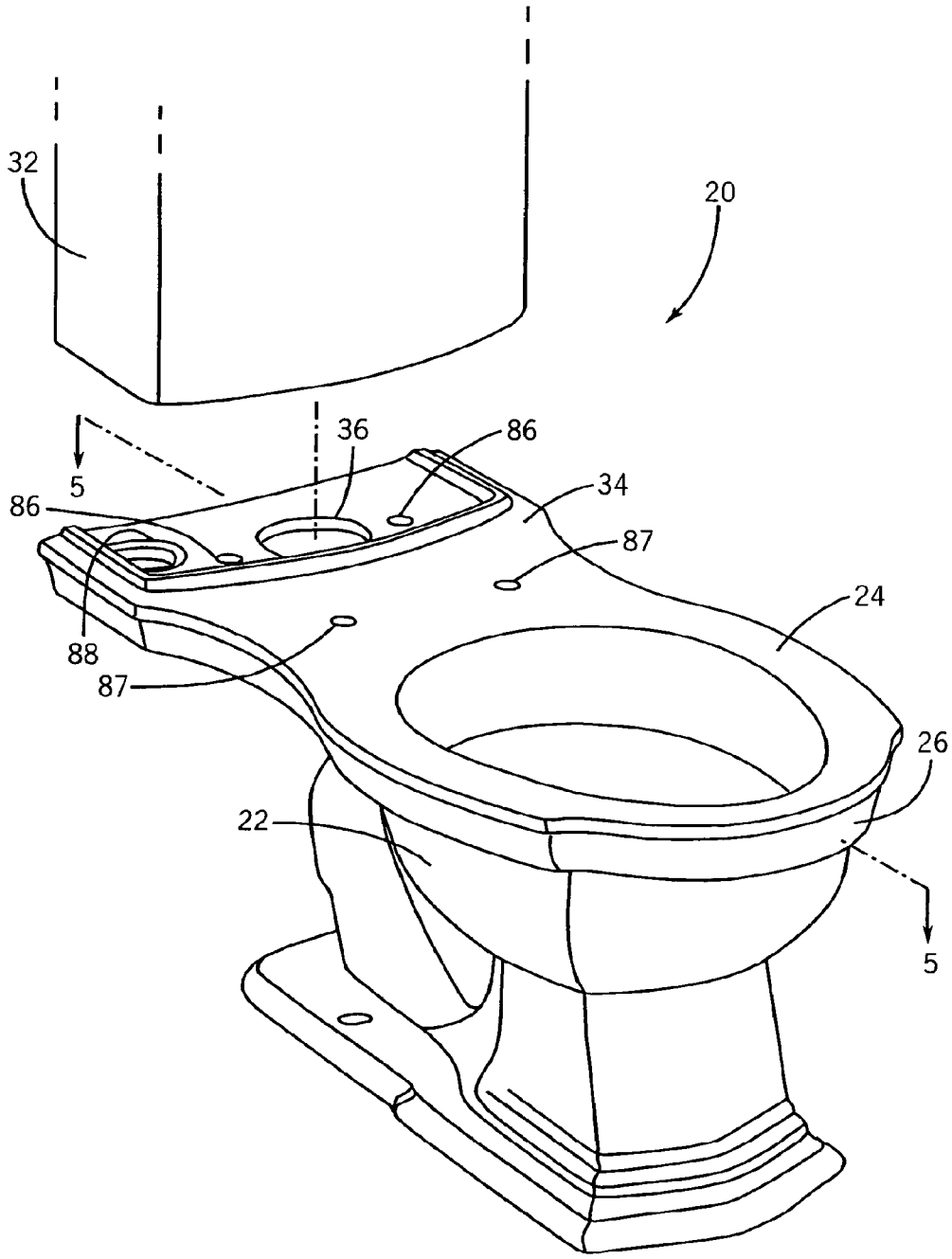
FIG. 1 is an exploded perspective view of a toilet according to an exemplary embodiment.
Figure 2:
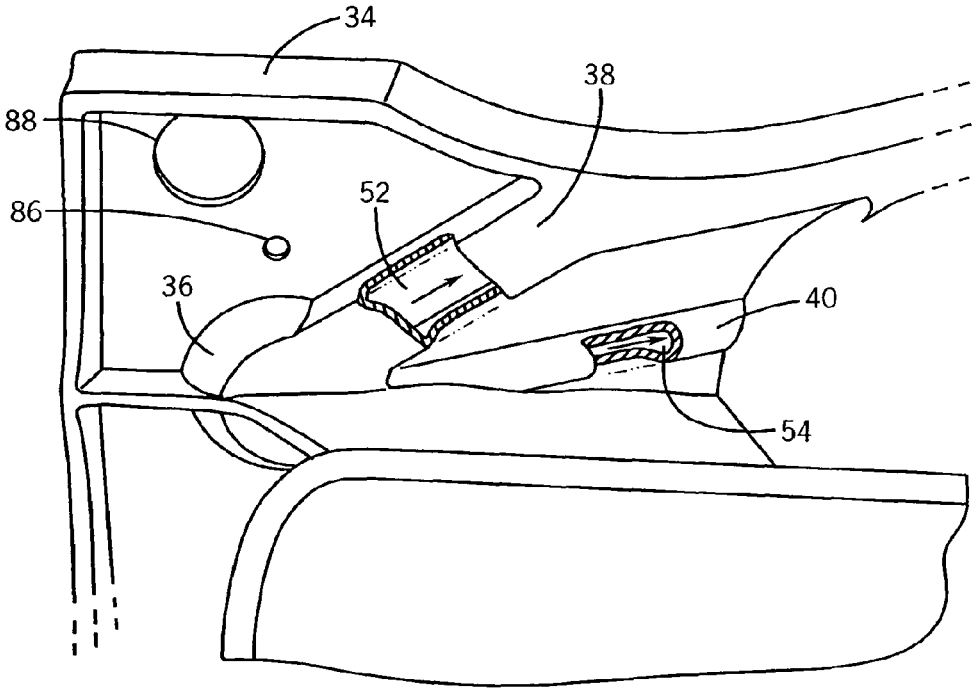
FIG. 2 is a lower, left fragmentary perspective view of a portion of the toilet of FIG. 1.
Figure 3:
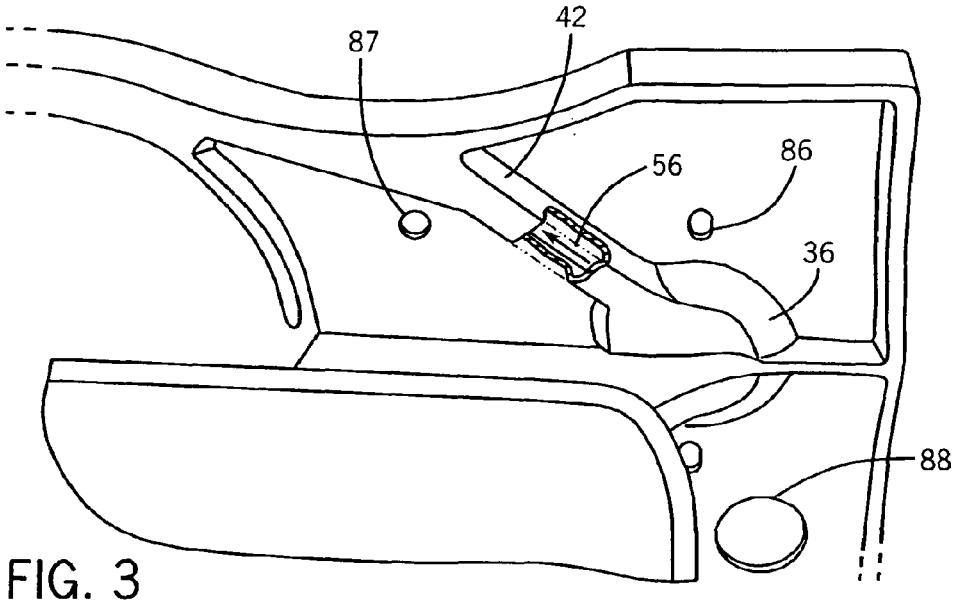
FIG. 3 is a lower, right fragmentary perspective view of the toilet of FIG. 1.
Figure 4A:
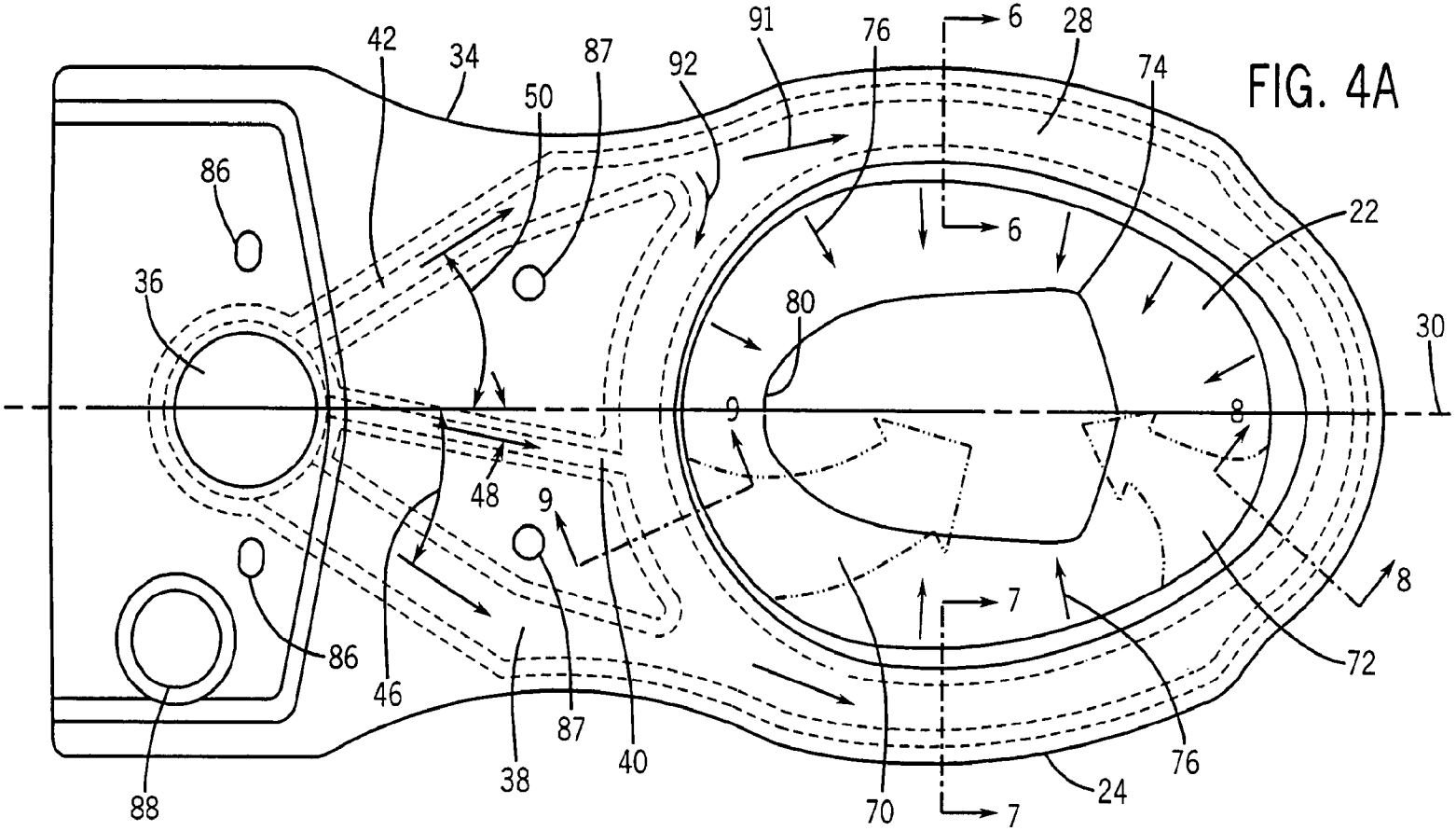
FIG. 4A is a top view of the toilet of FIG. 1, without the water tank, at the initiation of a flush cycle.
Figure 4B:
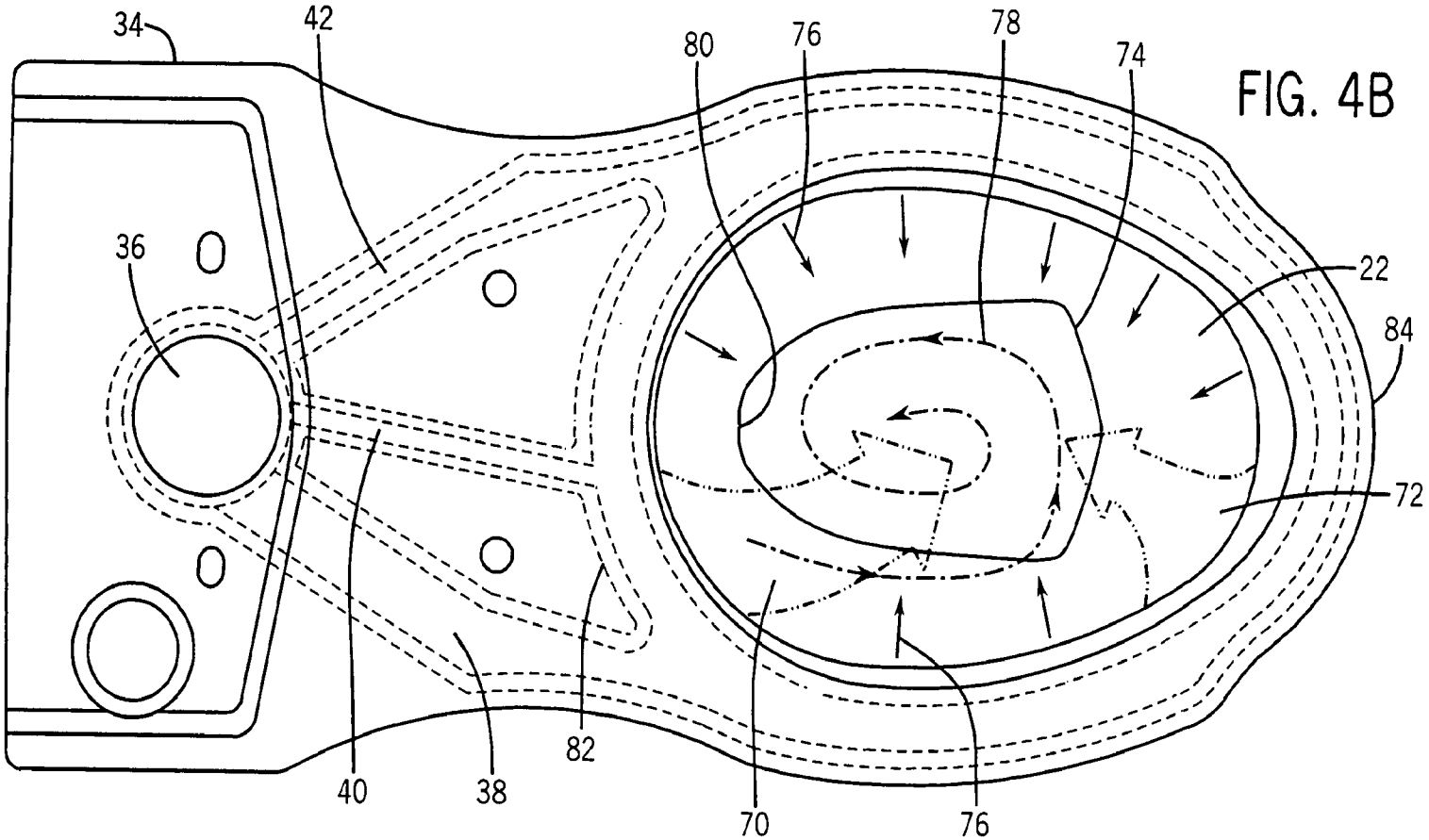
FIG. 4B is a view similar to that of 4A, but with the flush progressing into a cleaning vortex.
Figure 5:
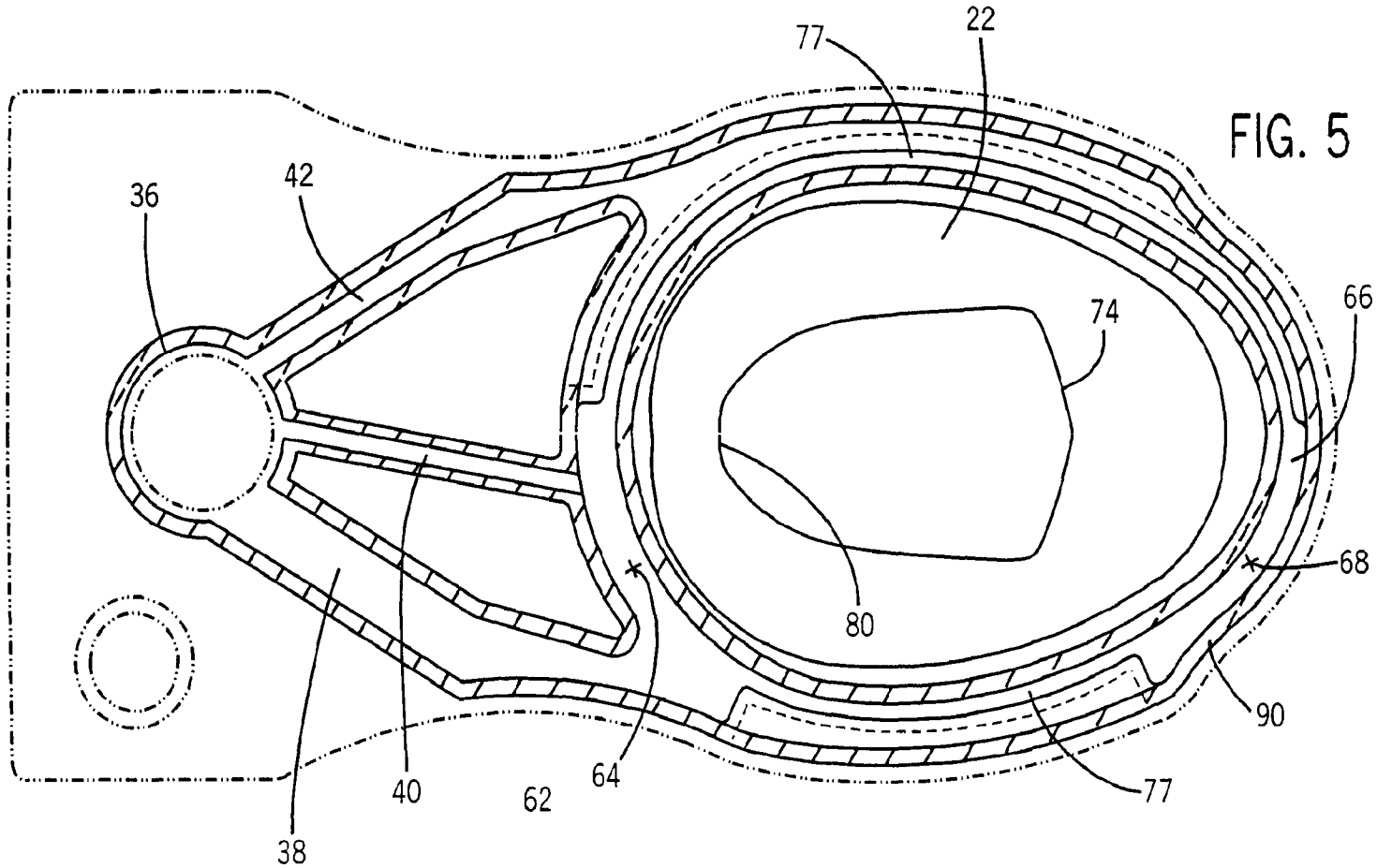
FIG. 5 is a cross-sectional view taken along section line 5-5 in FIG. 1.
Figure 6:
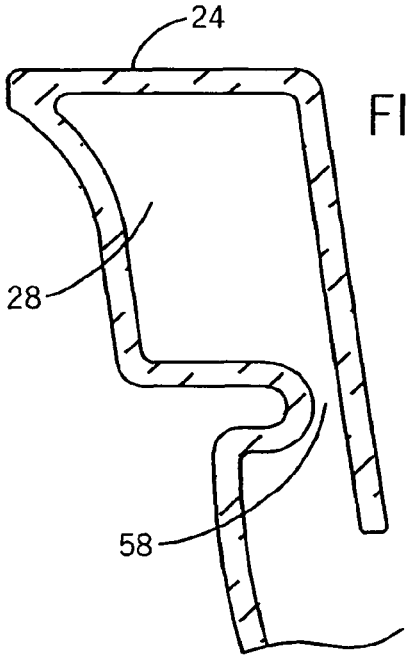
FIG. 6 is a cross-sectional view taken along section line 6-6 in FIG. 4A.
Figure 7:
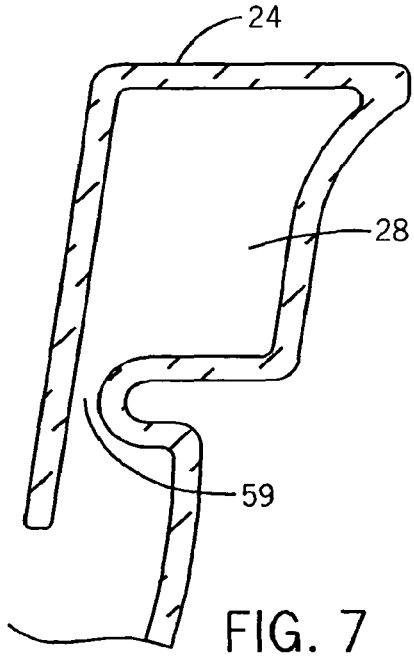
FIG. 7 is a cross-sectional view taken along section line 7-7 in FIG. 4A.
Figure 9:
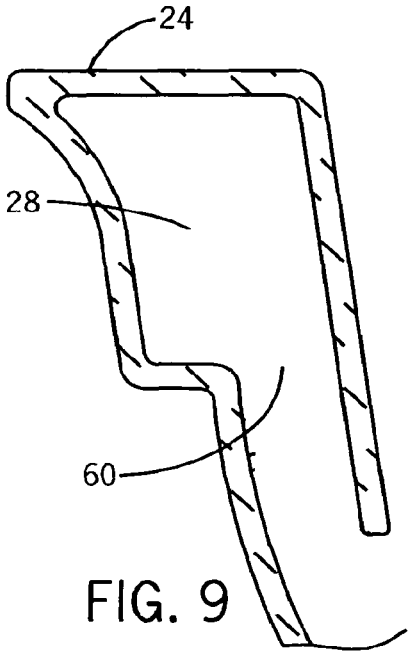
FIG. 9 is a cross-sectional view taken along section line 9-9 in FIG. 4A.
Figure 8:
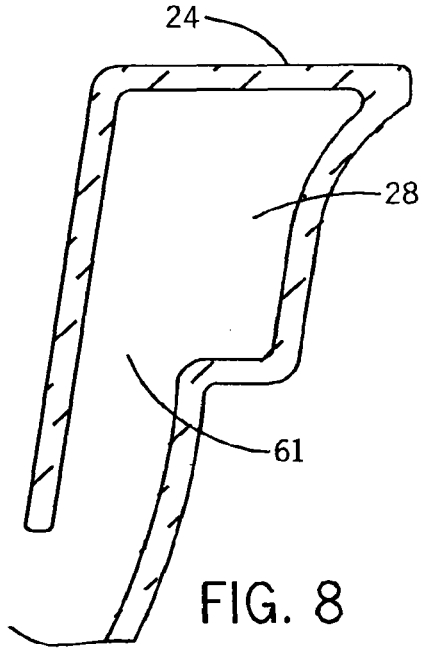
FIG. 8 is a cross-sectional view taken along section line 8-8 in FIG. 4A.

With general reference to the Figures, and more particularly to FIGS. 1, 4A, 4B and 5, there is shown a toilet 20 which includes a bowl 22 with a rim 24 at an upper extent 26 of bowl 22. The rim 24 has a rim channel 28 therein. The bowl 22 can be conceptually considered to have a central vertical plane 30.

There is a water tank 32, which may have the usual internal flush valve, a flush actuator and other fittings as are required (not shown). Alternatively, toilet 10 can be a tankless design which is directly connected to line water pressure via a Flushometer type valve (also not shown). The bowl 22 discharges into a trap and drain line (also not shown).

A rear extension 34 can extend from rim 24. It includes a water distributor structure 36 which is in communication with both the water supply and three exit channels 38, 40 and 42. The exit channels in turn are in fluid communication with the rim channel 28. The channels 38, 40, 42 extend at corresponding angles 46, 48, 50 respectively. Each of the channels 38, 40, 42 are nonparallel with the vertical central plane 30.

The angle 46 is greater than the angle 48, and the angle 50 is greater than the angle 48, for optimal vortex formation. The channel 38 and the channel 40 are on the same side of the vertical central plane 30 as each other, and the channel 42 is on an opposite side.

While three exit channels are preferred, it should be appreciated that to address particular concerns with particular style toilets one or more additional exit channels may be also used. Further, where one of the exit channels provides both clockwise and counter clockwise flow due to its angle of entry and positioning, in some cases only two exit channels need be used.

In any event, in our preferred embodiment, the channel 38 has a larger cross-sectional area 52 than the channel 40 with its cross-sectional area 54, or that of channel 42 and its cross-sectional area 56. The cross-sectional area 56 is in turn preferably larger than cross-sectional area 54. These further facilitate vortex formation, as well as help facilitate evacuation of the bowl. For example, the channel 38 could take 33% to 45% of the total flow, the channel 42 could take 27% to 39% of the total flow, and the channel 40 could take 21% to 33% of the total flow.

The rim 24 of the toilet 20 has gaps 58, 59, 60, 61 (FIGS. 5-9) which allow the flush water to exit continuously from the rim channel 28 into the bowl 22, albeit at different rates at different places depending on the gap's size. Two distinct sections of the larger gaps 60, 61 in the rim 24 designates a first biasing flow aperture/enlarged opening 62 having a first center 64 and a second biasing flow aperture/enlarged opening 66 having a second center 68. The center 68 is preferably −30 degrees to +30 degrees from straight forward, and the center 64 is preferably −30 degrees to +30 degrees from rear.

The orientation and design of biasing flow apertures/enlarged openings 62, 66, in conjunction with the orientation and design of the channels 38, 40, 42, create first biasing flow 70 and second biasing flow 72, which merge in the vicinity of the sump area 74. This merging/collision, along with the other rim wash 76 emanating from secondary flow apertures 77, develops into a vortex flow 78 which exits toilet 20 through an outlet 80 in the sump area 74, overcomes the verge of the toilet trap, helps creates a siphon discharging the contents of the bowl 22 into the trap and sewer line, and then recreates the bowl seal.

The center 64 and center 68 are in this embodiment on a same side of the vertical central plane 30. The bowl 22 has a water inlet side 82, and a forward side 84 opposite water inlet side 82, where the first biasing flow aperture/enlarged opening 62 can be on water inlet side 82, and second biasing flow aperture/enlarged opening 66 can be on the forward side 84.

The gap 58 can be the same or different than the gap 59. Similarly, the gap 60 can be the same or different than the gap 61. The gaps 60, 61 are larger than the gaps 58, 59.

Note that the narrowing of the gaps 58 and 59 relative to the gap 60 serves a number of functions. For one thing, it permits more of the water from the channel 38 to reach the enlarged opening 66, while still permitting some water to flow down the bowl sides near 77.

For another, it helps deliver the water to a rim tapering area 90 in sufficient amounts that the water speed is accelerated as it is delivered to the opening 66. This added boost further assists in evacuation and vortex formation.

It should also be noted that water coming out of the channel 42 primarily flows clockwise as shown by the arrow 91. However, there is also a secondary flow 92 counter clockwise to help clean the rear portion of the upper bowl. This is important because the channel 40 is angled away from that region of the bowl to preserve the energy of the water.

The toilet 20 can include mounting holes 86, 87 for respectively mounting the water tank 32 and a toilet seat (not shown), and a tank inlet hole 88 for providing access for the water tank 32 water inlet (not shown).

Figure 10:
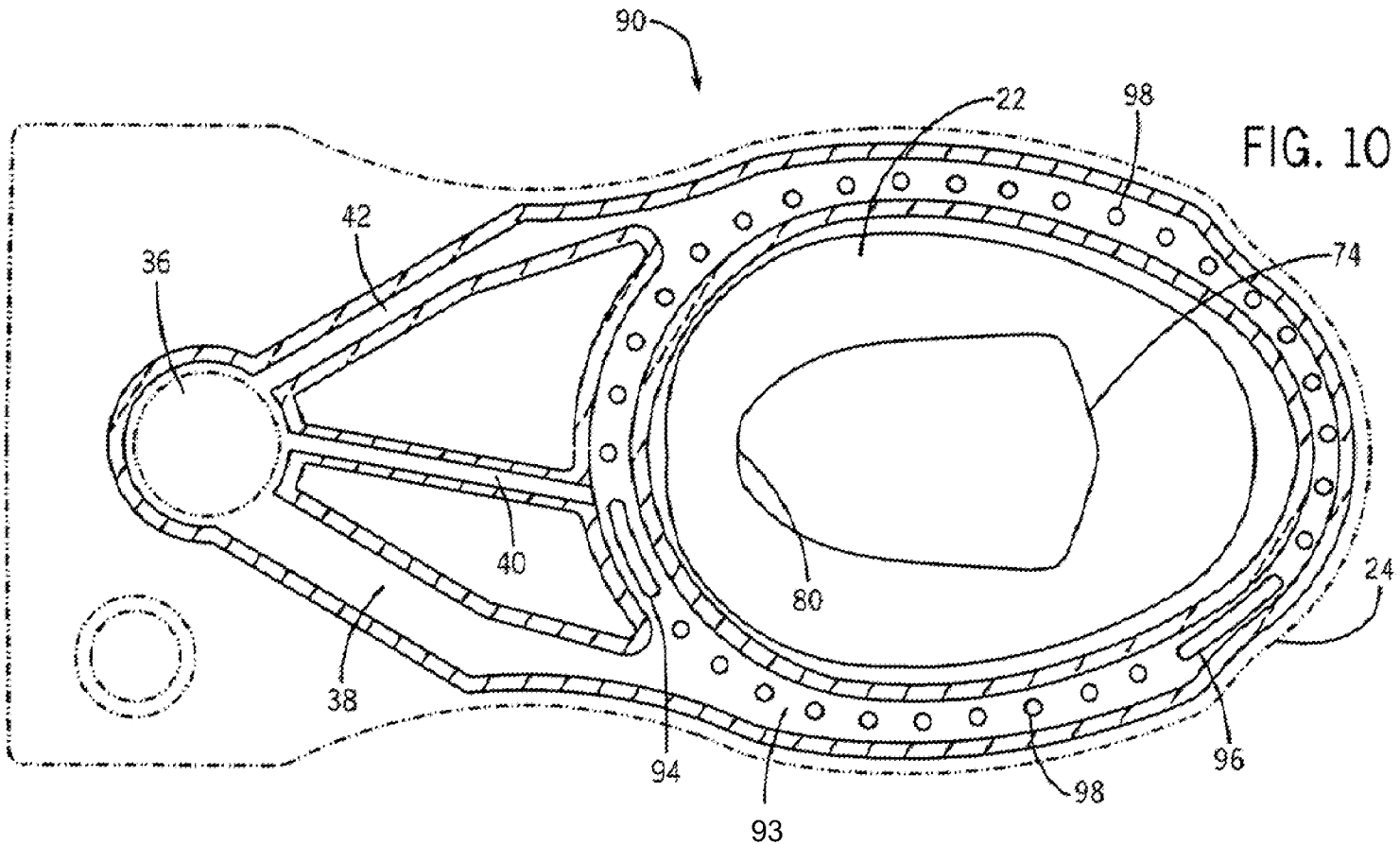
FIG. 10 is a cross-sectional view of another exemplary embodiment of a toilet, which is similar to FIG. 5, but instead illustrates a holed rim structure instead of an open rim design.

The embodiment of the toilet 20 illustrated in FIGS. 1-9 has a rim channel 28 that discharges through a continuous gap, an "open rim" type design. However, the present invention can also be applied to other types of rim channels. For example, FIG. 10 illustrates a toilet 90 which has a rim channel 93 wherein the first biasing flow aperture comprises a first water delivery slot 94 along an underside of the rim, and the second biasing flow aperture comprises a second water delivery slot 96 along the underside of the rim. The secondary flow apertures comprise at least one additional water delivery hole 98 in the rim each smaller than first water delivery hole 94 and/or second water delivery hole 96. Other aspects of the toilet 90 are the same or similar to the toilet 20.

Figure 11:
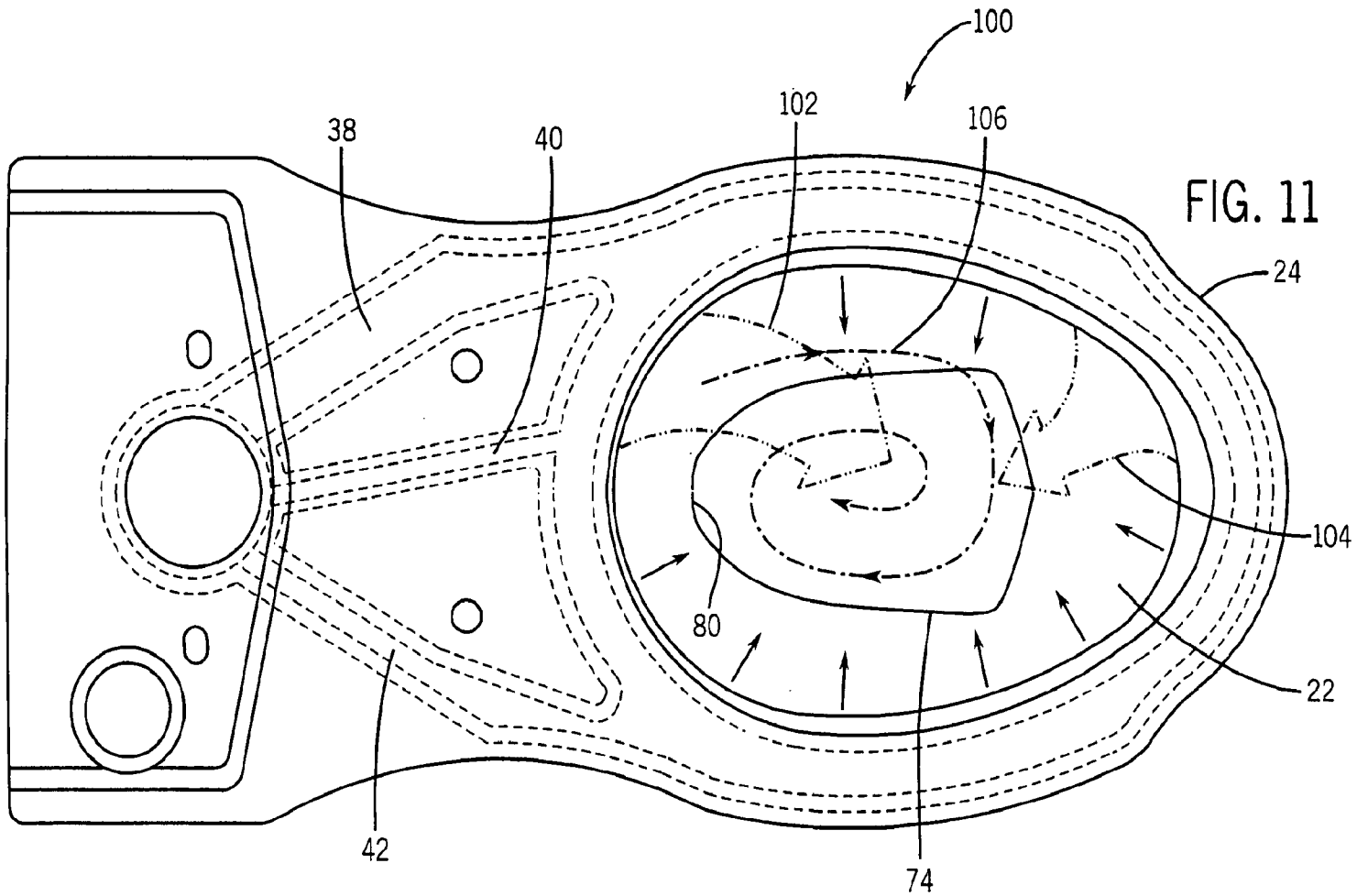
FIG. 11 is a top view of yet another exemplary embodiment of a toilet.

Although the embodiments of FIGS. 1-10 illustrate a counterclockwise vortex flow, the present invention can be adapted for clockwise flow as illustrated in FIG. 11. In this regard, the toilet 100 has the channels 38, 40, 42, which have been placed on the respective other side of the vertical central plane 30 when compared to the placement in the toilet 20. Similarly, although not shown, the first biasing flow aperture and the second biasing flow aperture are placed on the respective other side of the vertical central plane 30 when compared to the corresponding placement in the toilet 20, to produce first biasing flow 102 and second biasing flow 104, which results a clockwise vortex flow 106. This arrangement can be applied to the open rim arrangement of the toilet 20 or the hole arrangement of the toilet 90, or some combination thereof.

Further, it should be noted that while flow has been described in the rim channel with reference to both clockwise and counter clockwise flow, it is highly desirable that these mixed direction flows quickly result in a one direction vortex. Hence, for flow out of the channel 42 it is desirable for most of the clockwise energy to be out of the water when it starts dropping along the bowl sides. This can be achieved by elongating channel 42 relative to the channel 38, and also by widening the rim channel from 6 o'clock to 12 o'clock.

We also prefer to have embodiments where when the flush cycle starts the first water enters from the channel 38 as compared to the channel 42. This further facilitates vortex formation. We achieve this by having the channel 38 longer than the channel 42.

Therefore, the present invention is not to be limited to just the described most preferred embodiments. Rather, in order to ascertain the full scope of the invention, the claims which follow should be referenced.

INDUSTRIAL APPLICABILITY

The present invention provides a toilet with reduced water usage while retaining effective cleaning and other performance.

What is claimed is:

1. A toilet, comprising:

a bowl;

a rim provided at an upper portion of the bowl;

a rim channel disposed in the rim having a first opening, a second opening, and a third opening located between the first and second openings, the openings configured to communicate water to the bowl;

a rear extension that extends from the rim; and a water distribution structure provided in the rear extension and configured to receive water from a water supply, the water distribution structure having at least two exit channels configured to communicate water to at least two different locations of the rim channel.

2. The toilet of claim 1, wherein a first of the exit channels includes at least one characteristic that is different from a second of the exit channels, the at least one characteristic being one of an angle relative to a vertical central plane of the toilet, a position relative to the vertical central plane, or a flow rate.

3. The toilet of claim 2, wherein the first exit channel and the second exit channel are configured to form a vortex in the bowl.

4. The toilet of claim 2, further comprising a third exit channel, and wherein the flow rate of the first exit channel is between 33% and 45% of total flow to the rim channel, the flow rate of the second exit channel is between 21% and 33% of the total flow to the rim channel, and a flow rate of the third exit channel is between 27% and 39% of the total flow to the rim channel.

5. The toilet of claim 2, further comprising a third exit channel, wherein the angle of the first exit channel is greater than an angle of the third exit channel, and wherein the angle of the second exit channel is greater than the angle of the third exit channel.

6. The toilet of claim 2, wherein the first exit channel and the second exit channel are positioned on different sides of the vertical central plane.

7. The toilet of claim 6, further comprising a third exit channel, wherein the third exit channel is positioned on the same side of the vertical central plane as the first exit channel.

8. The toilet of claim 1, wherein the rim channel includes a plurality of openings located between the first and second openings.

9. The toilet of claim 8, wherein the first and second openings are larger in size relative to the size of the plurality of openings.

10. The toilet of claim 1, wherein the first and second openings are larger in size relative to the size of the third opening.

11. A toilet, comprising:

a bowl having an upper rim channel, the rim channel having at least two openings therein; and a water distribution structure for delivering water from a water supply to the bowl to form a vortex of water in the bowl, the water distribution structure having an entry configured to link with the water supply and at least three exit channels;

wherein a first of the exit channels is configured to communicate water with the rim channel so as to provide at least a counterclockwise flow around a first side of the rim channel;

wherein a second of the exit channels is configured to communicate water with the rim channel so as to provide at least a clockwise flow around an opposed side of the rim channel from the first side of the rim channel; and wherein a third of the exit channels is configured to communicate water with a rearward portion of the rim channel.

12. The toilet of claim 11, wherein the at least two openings in the rim channel include a first opening located in a rearward portion of the bowl, a second opening located in a forward portion of the bowl, and at least one additional opening located between the first and second openings.

13. The toilet of claim 12, wherein the first and second openings of the rim channel are larger in size relative to the size of the at least one additional opening located between the first and second openings.

14. The toilet of claim 11, wherein the third exit channel is configured to feed water to the rim channel at an angle relative to the rim channel when water is supplied to the water distribution structure.

15. The toilet of claim 11, wherein the first exit channel is configured to carry a greater volume of water than the second exit channel.

16. The toilet of claim 11, wherein the first and second exit channels are both configured to carry greater volumes of water than the third exit channel.

17. The toilet of claim 11, wherein the first exit channel is longer than the second exit channel, such that water supplied to the water distribution structure will first reach the rim channel from the first exit channel as compared to the second exit channel.

18. The toilet of claim 12, wherein the bowl has a forward-to-back vertical central plane such that the first and third exit channels link with the rim channel on one side of the vertical central plane and the second exit channel links with the rim channel on an opposite side of the vertical central plane from said one side of the vertical central plane.

19. The toilet of claim 18, wherein the first and second openings both have a central region on a same side of the vertical central plane.

20. A toilet, comprising:

a bowl;

a rim located at an upper portion of the bowl, the rim having a rim channel that includes:

a first opening located in a rearward portion of the bowl and configured to deliver water to the bowl;

a second opening located in a forward portion of the bowl and configured to deliver water to the bowl; and at least one additional opening located between the first and second openings, the at least one additional opening having a size that is smaller than the size of either one of the first or second openings; and a water distribution structure configured to deliver water from a water supply to the bowl to form a vortex of water in the bowl, the water distribution structure having an entry configured to link with the water supply and at least two exit channels;

wherein a first of the exit channels is configured to communicate water with the rim channel so as to provide both a counter clockwise flow and a clockwise flow around a first side of the rim channel; and wherein a second of the exit channels is configured to communicate water with the rim channel so as to provide a flow pattern selected from the group consisting of clockwise flow and counter clockwise flow around an opposed side of the rim channel from the first side of the rim channel.

* * * * *